US007111824B2

(12) United States Patent
Harala

(10) Patent No.: US 7,111,824 B2
(45) Date of Patent: Sep. 26, 2006

(54) TOOL FOR USE WITH X CLAW HAMMER IN REMOVAL OF NAILS

(75) Inventor: Gregory M. Harala, Rainer, MN (US)

(73) Assignees: Warren Korzinski, International Falls, MN (US), part interest; Bradley D. Harala, Post Falls, ID (US), part interest ( * ) Notice: Subject to any disclaimer, the term of this patent is extended or adjusted under 35 U.S.C. 154(b) by 32 days.

(21) Appl. No.: 10/683,163

(22) Filed: Oct. 14, 2003

(65) Prior Publication Data

US 2004/0227132 A1 Nov. 18, 2004

Related U.S. Application Data

(63) Continuation-in-part of application No. 10/358,383, filed on Feb. 5, 2003, now abandoned.

(51) Int. Cl.
*B66F 15/00* (2006.01)

(52) U.S. Cl. ..... 254/26 R

(58) Field of Classification Search ..... 254/26 E, 254/26 R; 81/20

See application file for complete search history.

(56) References Cited

U.S. PATENT DOCUMENTS 2,110,057 A * 3/1938 Scheurer ..... 254/26 R

* cited by examiner

*Primary Examiner*—Robert C. Watson
(74) *Attorney, Agent, or Firm*—Adrian D. Battisoh; Michael R. Williams; Ryan W. Dupuis

(57) ABSTRACT

A tool is provided for use in combination with a conventional claw hammer. The tool comprises an integral tool body having a sleeve for surrounding the cylindrical striker section of the hammer head. A support portion extends outwardly from the sleeve generally at right angles to the longitudinal axis of the sleeve and carries at its remote end a surface engaging curved portion for resting against the surface from which a nail is to be pulled and for acting as a fulcrum holding the hammer away from the surface to improve the direction of pull on a nail grasped by the claw of the claw hammer. The surface engaging portion at the end of the tool has an apex at one end including a sharpened claw for engaging a fully embedded nail. At the opposed end is provided an anvil surface which can be struck by the hammer to drive the apex into position to grasp a nail. The tool has two steps therefore firstly being used to grasp an embedded nail and secondly being used with the hammer head engaged into the receptacle as an additional fulcrum of the hammer.

8 Claims, 6 Drawing Sheets

TOOL FOR USE WITH X CLAW HAMMER IN REMOVAL OF NAILS

This application is a Continuation-in-Part Application of parent application Ser. No. 10/358,383 filed Feb. 5, 2003 now abandoned.

BACKGROUND OF THE INVENTION

This invention relates to a tool for use with a claw hammer in the removal of nails from a surface.

The conventional claw hammer is of course very well known and comprises a shank and a generally T-shaped hammer head having a shank engaging portion defined by a leg of the T-shape, a striker body on one side of the T-shape having an end striker face generally at right angles to a striker axis which is at right angles to the shank. On the other side of the T-shape is provided a claw body including a pair of claw fingers projecting away from the shank and defining a slot therebetween for receiving and grasping a nail head. The claw hammer is convenient for pulling nails in that the claw fingers engaged on either side of the nail and then the shank of hammer is pulled in a plane at right angles to the surface are the so that the upper surface of the hammer heads acts as a fulcrum to pull the nail out of the surface into which it is engaged. One problem which arises with the pulling of nails in this way is that where the nail is relatively long for example in framing nails, the fulcrum is insufficiently spaced from the surface in which the nail is embedded so that when the head of the nail is beyond about half inch to one inch from the surface the nail begins to bend as the pull from the claw is in the wrong direction. This makes pulling the nail extremely inconvenient and requires significantly more force since the force is not in the required direction. In addition this causes bending of the nails as they are pulled so that they are then unsuitable for further use.

Some users overcome this problem by providing a block of wood which is placed on top of the surface within which the nail is embedded so that the fulcrum surface of the hammer engages against a block of wood thus restoring the force on the nail to approximately the right direction. However the block of wood is somewhat inconvenient in that it must be carefully held and in that it must be carried around and thus made available at the required time.

At the present time no tool is commercially available for replacing this simple block of wood.

One proposal for a tool suitable for this purpose was made in U.S. Pat. No. 551,993 from December 1895 by Norton et al. In this arrangement a curved body is attached to the head of the hammer by engagement with the claw portion on one side, the striker body on the opposed side and with a loop which wraps over and screw-fastens to the shank engaging portion. This device is therefore highly inconvenient to attach and has found little or no favor in the trade so that it certainly is not commercially available at the present time.

A search carried out in relation to the present invention has also revealed U.S. Pat. No. 110,176 from December 1870 by Ward and U.S. Pat. No. 830,072 from September 1906 by Houlihan. Both of these devices are nail extractors which can engage a nail head and can be grasped by the claw section of a claw hammer to assist in pulling the nail.

SUMMARY OF THE INVENTION

It is one object of the present invention to provide a tool which can be used with a claw hammer for pulling nails.

According to a first aspect of the invention there is provided a combination of a claw hammer and a tool for, use therewith in removing nails, the claw hammer comprising a shank and a generally T-shaped hammer head having a shank engaging portion defining a leg of the T-shape and engagement with the shank, a striker body on one side of the T-shape having an end striker face generally at right angles to a striker axis which is at right angles to the shank and a peripheral surface surrounding the striker axis, and a claw body on a side of said T-shape opposite to said striker body including a pair of claw fingers projecting away from the shank defining a slot therebetween for receiving and grasping a nail head of a nail in a surface for removal, the tool comprising an integral tool body having a receptacle portion, a support portion and a service engaging portion, the receptacle portion defining a sleeve shaped to receive and surround the peripheral surface of the striker body as a sliding fit therein so as to be supported on the striker body by the engagement between the striker body and the sleeve, the support portion extending outwardly to one side of the receptacle portion generally at right angles to the striker axis and a service engaging portion being mounted on an end of the support portion remote from the receptacle portion and providing a curved fulcrum surface for resting on the surface from which the nail is to be pulled with the shank lying in a plane at right angles to the surface, the curved fulcrum surface being curved in a direction to roll over the surface as the tool is pivoted relative to the surface in said plane about an axis at right angles to the striker axis and to the shank.

According to the second aspect of the invention there is provided a tool for use with a claw hammer comprising a tool body having a receptacle portion defining a circular cylindrical recess having an open end face generally at right angles to a longitudinal axis of the recess, a support portion extending from the receptacle portion generally at right angles to the axis, and an engagement portion on an end of the support portion remote from the receptacle portion and defining a curved fulcrum surface facing away from the receptacle portion, the curved fulcrum surface being formed from a series of parallel straight lines at right angles to the axis with the surface being curved about an axis parallel to the straight lines and offset from the surface in a direction toward the receptacle portion, the surface extending over an arc commencing at one end and terminating at a second end both ends being arranged at positions spaced from said longitudinal axis, said engagement portion having at said one end an anvil surface thereon transverse to the surface for driving the engagement portion generally longitudinally of the surface at right angle to said series of lines, and said engagement portion having at said second end a claw member defined by a pair of fingers having therebetween a V-shape notch lying generally in said surface for grasping a nail head between said fingers.

BRIEF DESCRIPTION OF THE DRAWINGS

One or more embodiments of the invention will now be described in conjunction with the accompanying drawings.

In the drawings like characters of reference indicate corresponding parts in the different figures.

DETAILED DESCRIPTION

Figure 1:
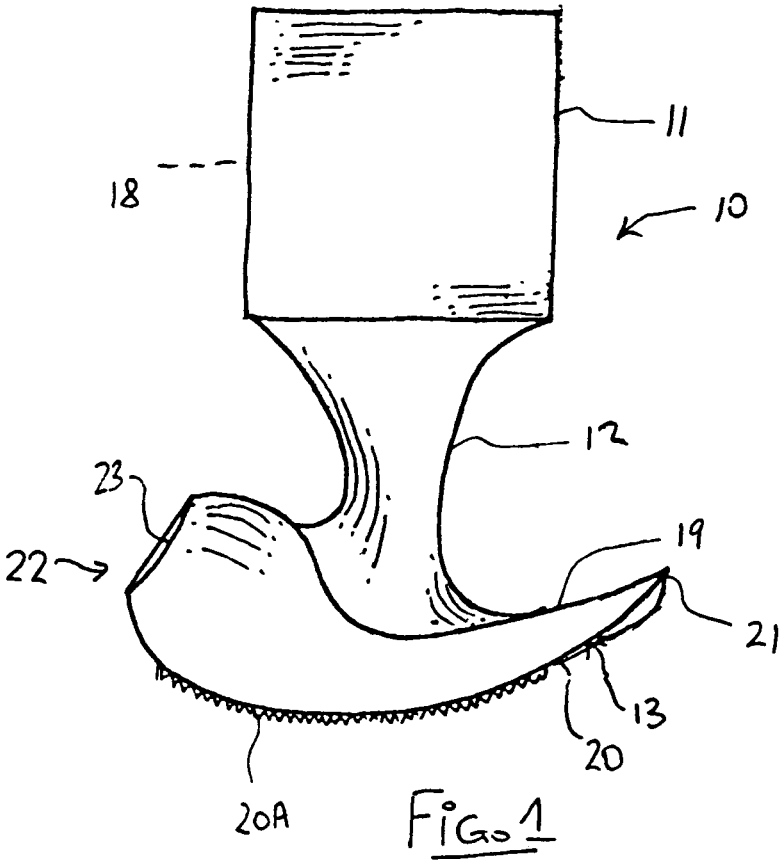
FIG. 1 is a side elevational view of a tool according to the present invention for use with a claw hammer in extraction of nails.
Figure 2:
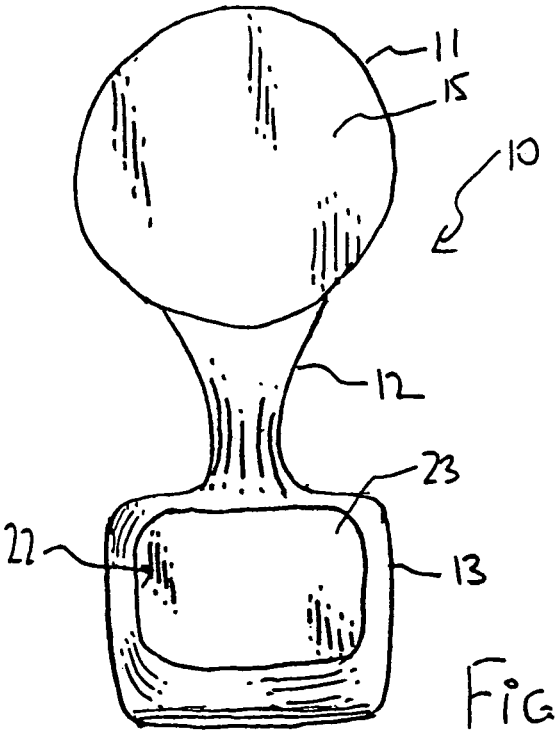
FIG. 2 is an end elevational view of the tool of FIG. 1 looking from the lefthand side.

Turning firstly to FIGS. 1 through 4 and 8, the tool according to the present invention is generally indicated at 10 and includes a receptacle portion 11, a support portion 12 and a surface engaging portion 13.

The receptacle portion 11 comprises simply a sleeve defined by a circular cylindrical wall 14 and an end wall 15 closing one end of the circular cylindrical wall and attached thereto. An opposed end of the circular cylindrical wall is open to define an open mouth 16 into which a striker body 17 of a hammer head can be inserted. The thickness of the wall 14 is selected simply to provide sufficient strength for the functions as described hereinafter and has a length in a longitudinal direction parallel to a longitudinal axis 18 sufficient just to receive the striker body 17 of the hammer head.

The support portion 12 comprises simply a strut integrally formed with one side face of the cylindrical wall 14 and extending outwardly therefrom generally at right angles thereto. The shape of the support portion 12 is generally unimportant but for convenience of construction commences at a width equal to the length of the sleeve 14 and then tapers downwardly to a narrowest point and expands wider again to provide a coupling to the surface engaging portion 13.

The surface engaging portion 13 includes an upper surface 19 integrally formed with the wider lower end of the support portion so as to smoothly couple therewith. The surface engaging portion 13, further includes an undersurface which constitutes a surface which engages the surface of the material from which the nail is to be withdrawn. The surface 20 is defined by a plurality of straight parallel lines transverse to the surface and at right angles to the axis 18. The surface however further curves around one or more axis parallel to the lines forming the surface and spaced therefrom toward the receptacle portion. This forms an arcuate surface which may be of constant arc around a single axis or as shown particularly in FIG. 1 may vary in curvature so that the centers of curvature are different for various different points along the length of the curved surface 20.

The body thus formed between the upper surface 19 and the lower surface 20 is therefore generally thin and elongate and is itself gradually curved following substantially along the curvature of the surface 20. However the body also increases in thickness from a pointed forward end 21 to a wider rearward end 22. On the surface 20 is provided a series of transverse ribs 20A defining a roughened area for grasping the surface of the frame element from which a nail is to be withdrawn.

At the rearward end 22 is provided an anvil surface 23 which is a substantially flat surface extending transversely to the general longitudinal direction of the body defining the surface engaging portion. This anvil surface can be struck by a hammer thus of course driving the body longitudinally of its length to force the front apex 21 forwardly as described hereinafter.

At the apex 21 is defined a claw portion generally indicated at 24. The claw portion includes a pair of fingers 25 and 26 forming therebetween a V-shaped slot 27. The fingers follow substantially the curvature of the surface 20. The V-shaped slot 27 has an open mouth at the apex 21 and itself lies in the plane of the surface 20 and tapers inwardly to a closed end 28 of the V-shaped slot for grasping a nail as the nail head is driven along the slot by forward movement of the apex 21.

Figure 3:
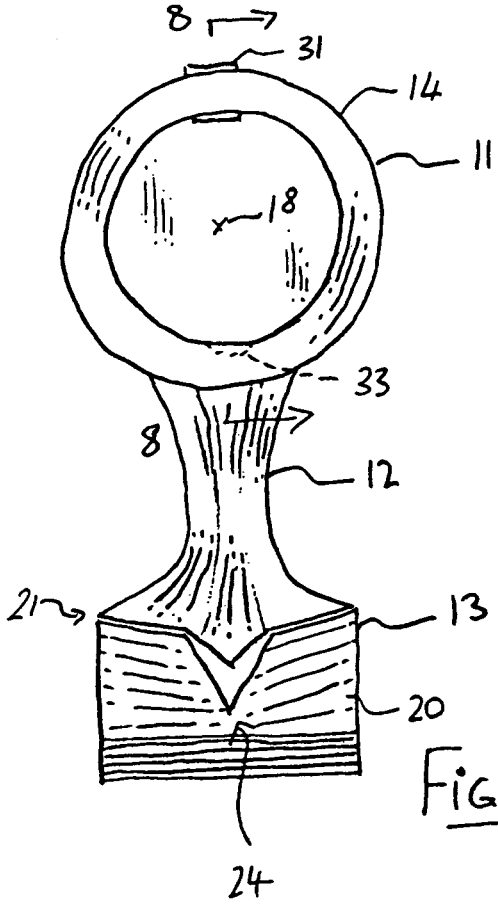
FIG. 3 is an end elevational view of the tool of FIG. 1 looking from the righthand side.
Figure 4:
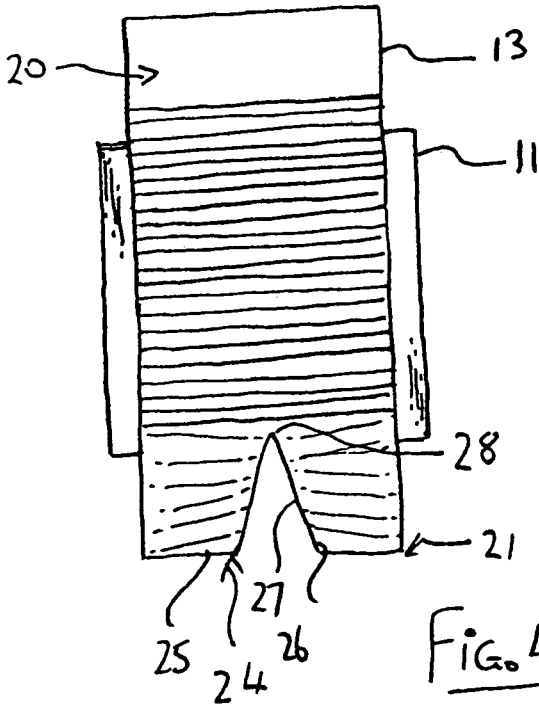
FIG. 4 is an underside view of the tool of FIG. 1.

As best shown in FIG. 3, the undersurface 20 in the area of the claw portion is itself slightly V-shaped so that at the intersection between the surface 20 and the slot 27 is formed a sharp cutting edge which can be driven into the surface around the nail to be extracted to more effectively grasp the nail head where that nail head is already embedded.

The receptacle portion 11 and particularly the sleeve 14 thereof further includes a threaded hole 30 passing through the wall thereof and receiving a set screw 31 which is externally threaded so that, the rotation of the screw drives the base end of the screw inwardly and outwardly relative to the wall 14. The screw includes a slot 32 by which it can be operated by a screwdriver. The wall further includes a recess 33 which is preferably opposite to the hole 30. Thus the set screw 31 can be positioned in the top of the wall 14 as best shown in FIG. 3 away from the surface engaging portion 13 whereas the recess 33 can simply be formed in the wall 14 opposite to the set screw so as to define a shallow recess within the internal surface of the sleeve 14.

A claw hammer is generally indicated at 40 and is conventional in nature including a shank 41. The hammer head includes a striker body 43 and 44 both of which are conventional nature. The generally of a hammer head 42 a claw section claw section includes a pair of fingers 45 defining therebetween a slot for receiving a head 46 of a nail 47 mounted within a surface 48. The hammer can be entirely conventional so that the striker body is simply of circular cylindrical shape size to be received as a sliding fit within the sleeve 14. The hammer can then be clamped into position onto the tool by actuation of the screw 31.

Alternatively the hammer head can be modified simply by the addition of a spring ball member 49 which is of a type that is well known including a simple spherical ball mounted within a recess 50 and urged outwardly by a spring 51 so as to project beyond the peripheral surface of the striker head. The spring ball thus can be compressed to allow insertion of the striker head into the sleeve 14. However when the spring ball reaches the recess 33 it expands out of its compressed position to engage into the recess and to assist in the frictional positioning of the striker body within the sleeve 14.

Figure 5:
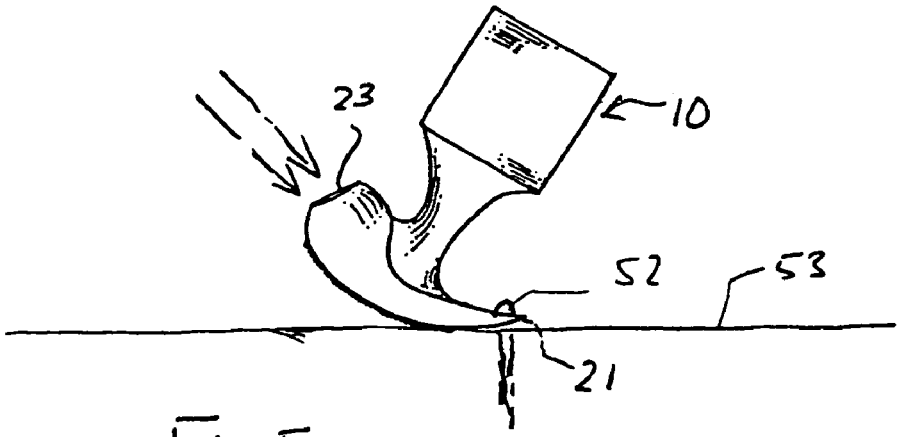
FIG. 5 is a side elevational view similar to that of FIG. 1 showing a first step of the tool in operation in relation to a nail embedded within a surface.
Figure 6:
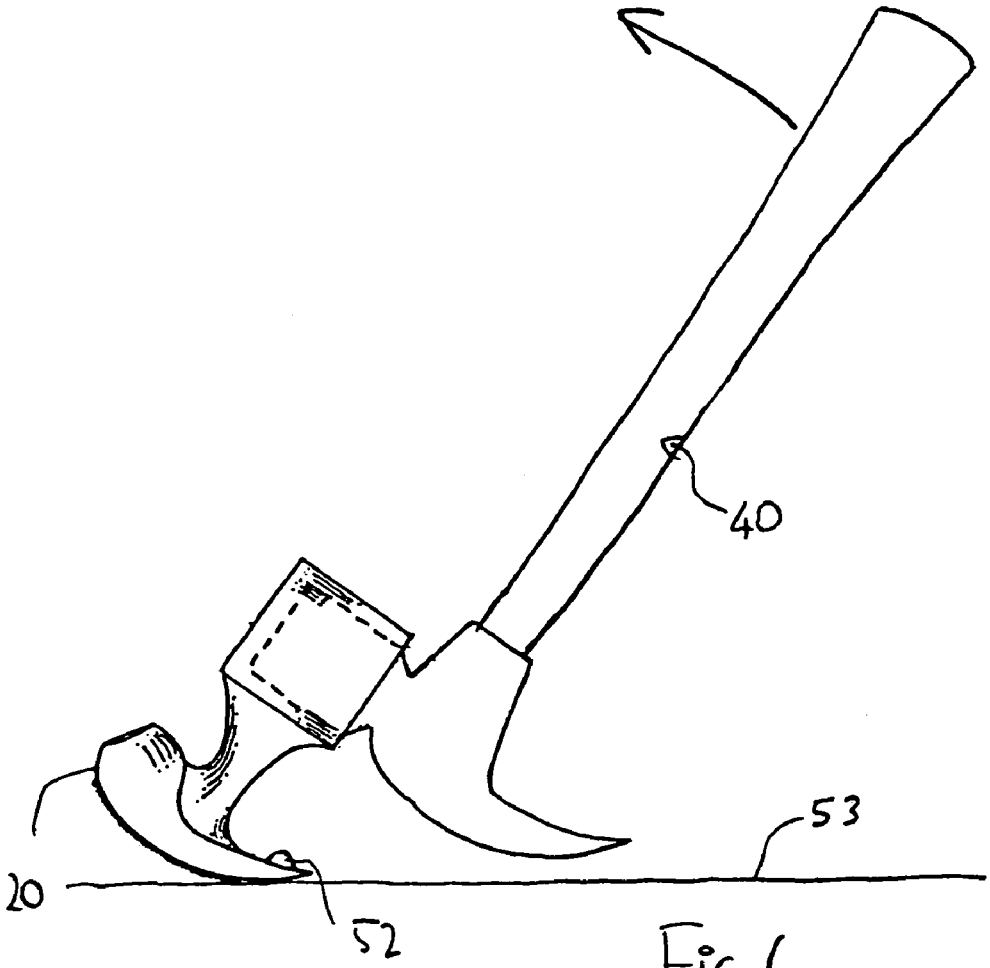
FIG. 6 is a side elevational view of the tool in combination with a claw hammer in a second step of operation.
Figure 7:
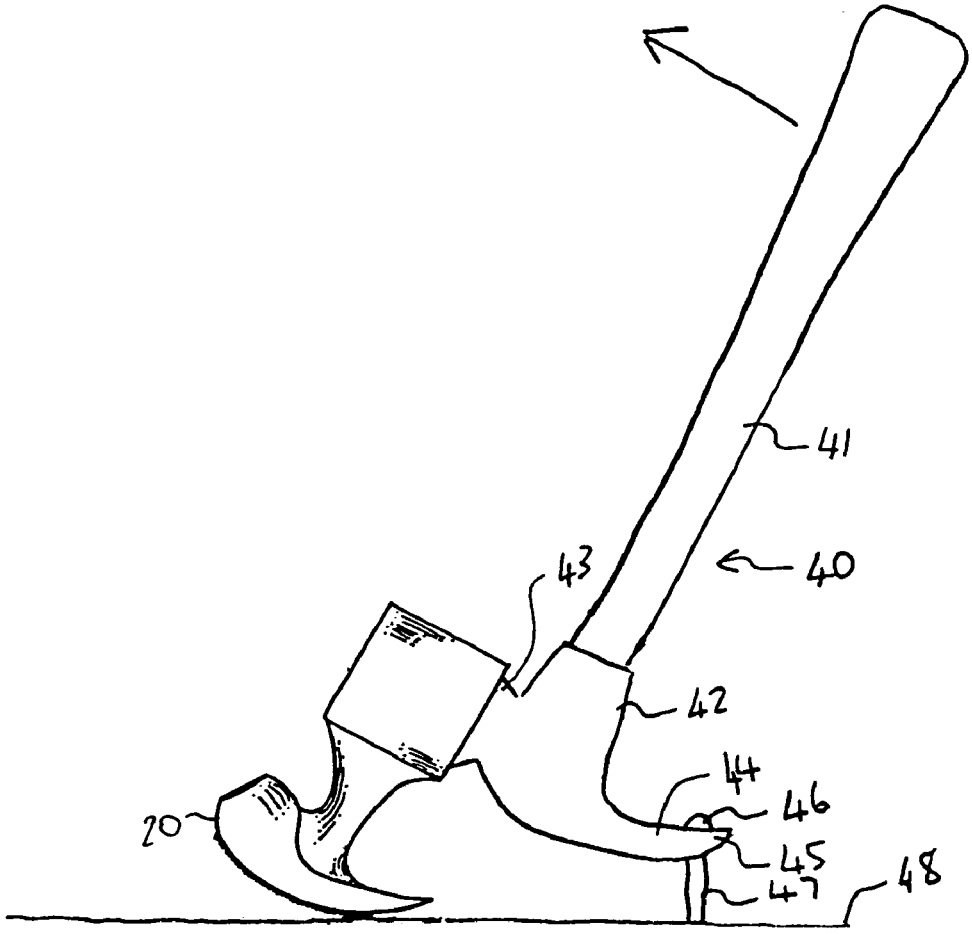
FIG. 7 is a side elevational view similar to that of FIG. 6 showing a third step of operation.
Figure 8:
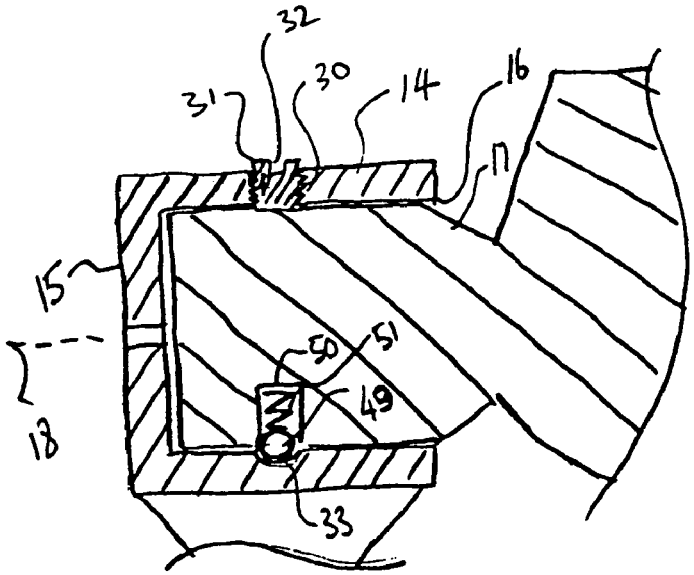
FIG. 8 is a cross sectional view taken along the lines 8—8 of FIG. 3.

The operation of the tool in combination with a conventional claw hammer is shown in FIGS. 5, 6 and 7.

In FIG. 5 where a nail 52 mounted within a surface 53 is deeply embedded and hence difficult to grasp by the conventional claw of the hammer, the tool 10 can be removed from the hammer and the claw portion thereof engaged onto the surface adjacent the nail 52. Hammer blows can then be applied to the anvil surface 23 to drive the apex 21 into the surface at either side of the head 52. This causes the claw portion to grasp the nail and to commence pulling the nail head from the surface 53. As soon as the nail head is effectively grasped by the claw portion, with the tool remaining in location holding the nail head, the hammer is inverted and the striker body of the hammer is inserted into the receptacle portion as shown in FIG. 6. The hammer can then be used as a lever to pull on the tool to effect a first extent of withdrawal of the nail 52 from the surface 53. As the hammer 40 is pivoted in the counterclockwise direction as shown in FIG. 6, the position of the fulcrum defined across the surface 20 gradually moves away from the nail to a position where the pulling direction is no longer vertically away from the surface 53. When this occurs the tool is removed from the nail and the hammer with the tool attached is moved into the position shown in FIG. 7 where the claw of the hammer grasps the nail 47 and the surface 20 is moved into contact with the surface 48 within the nail is embedded so that the surface engaging portion 13 acts as a fulcrum for the movement of the hammer in the counterclockwise direction as shown. This spacing of the fulcrum away from the end of the hammer means that the pull on the nail is more directly vertical for a longer distance of pull so that the nail can be pulled from the surface without the tendency to bend and without the inconvenient twisting action which is necessary when the conventional claw hammer is used.

During the movement of the combination as shown in FIG. 7 the roughened ribs 20A on the undersurface 20 act to prevent any slipping of the tool on the surface 48.

The dimensions of the sleeve 14 can be selected so that the tool is designed to accommodate a particular size of hammer. It may be necessary therefore for different sizes of the tool to be manufactured to accommodate the different sizes of hammers available. In the alternative, the tool may be supplied with a number of sleeves for example of a stiff rubber material which can be inserted into the sleeve 14 to accommodate different size hammer heads.

In a further alternative the roughening ribs 20A may be omitted for use on finishing surfaces to prevent damage to the actual surface of the material. In framing minor surface damage of this type is unimportant. In finishing it would be undesirable and hence the ribs can either be omitted or in an alternative (not shown) the ribs can be covered by a resilient pad which attaches to the tool.

Figure 9:
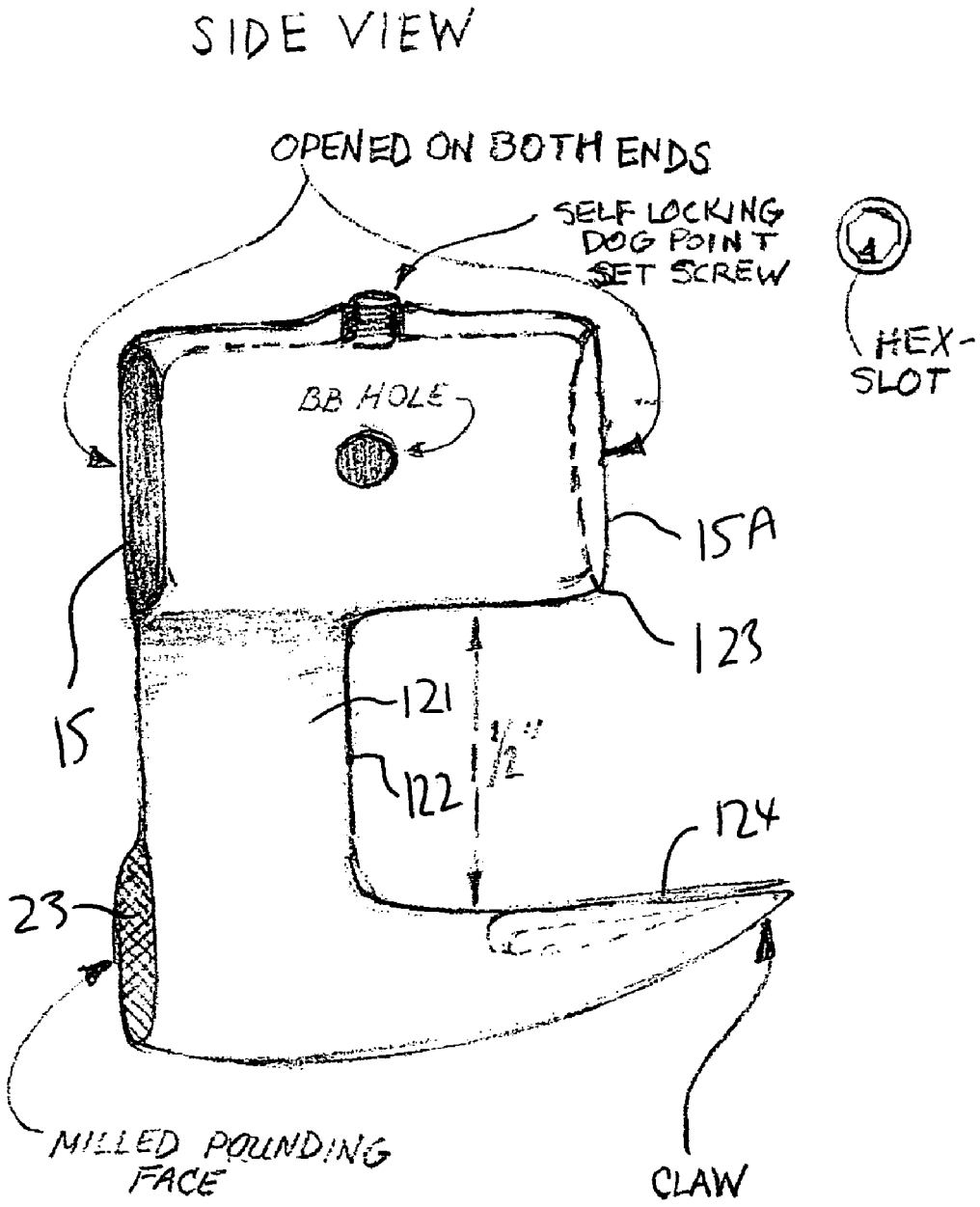
FIG. 9 is a side elevational view of a modified embodiment.

In a further alternative arrangement shown in FIG. 9, the connecting portion 112 is moved to the rear face 15. This increases the spacing between the front face 15A and a front edge 122 of the connecting portion 112 and places the rear face 15, the rear face of the connecting portion and the pounding face 23 in the common plane at right angles to the axis of the sleeve. Also the spacing between the bottom edge 123 of the sleeve and the top edge 124 of the claw is increased and arranged to be of the order of 1.5 inches allowing a 2 by 4 to be inserted therebetween to be grasped by the tool for straightening other leverage function thereon. The locking screw 32 is at the top and the ball 33 on one side face.

Figure 10:
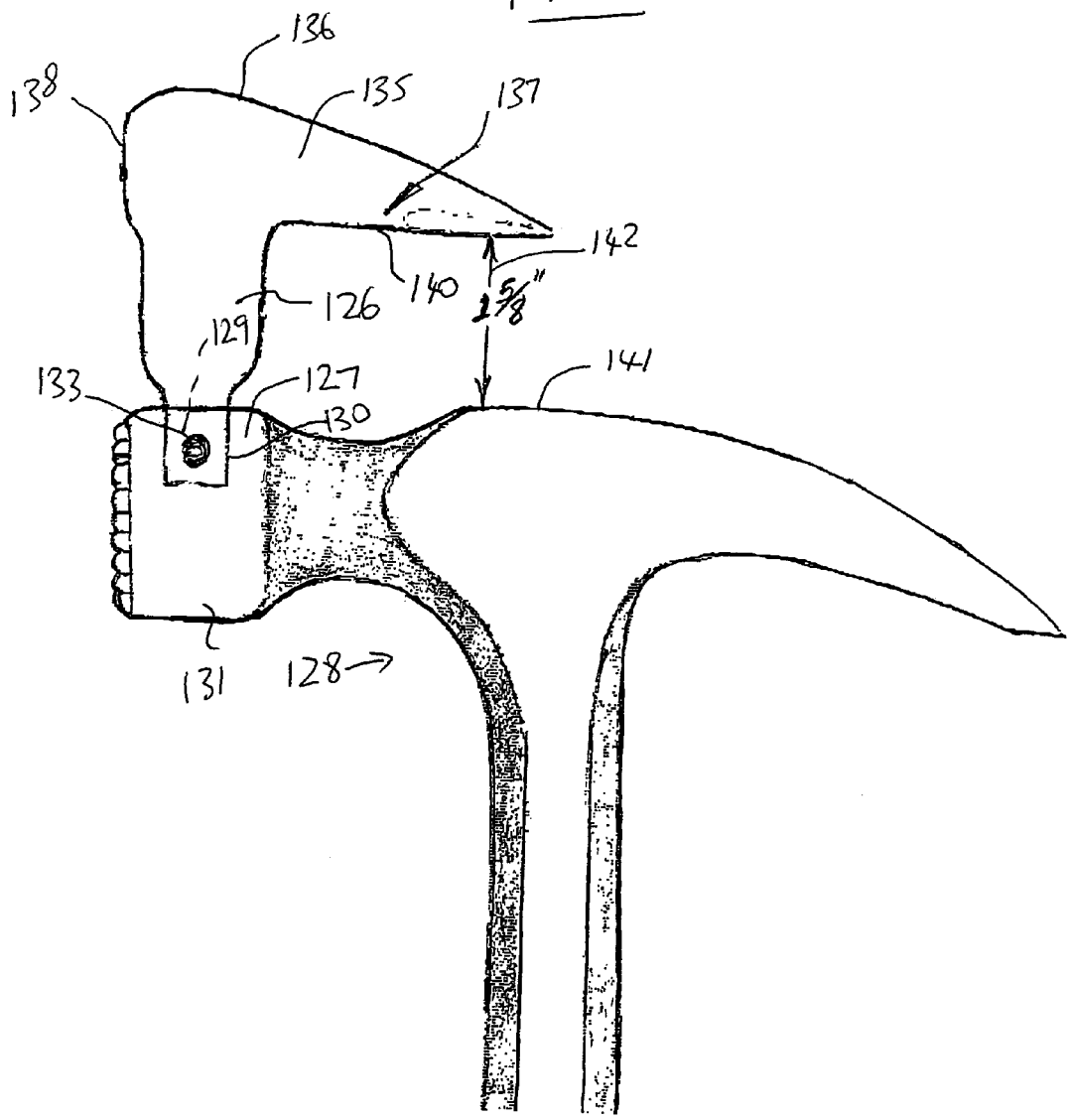
FIG. 10 is a side elevation view of a further modified embodiment.

In FIG. 10 is shown a yet further modified arrangement which includes a support portion 126 which is attached to the striking head 127 of a hammer 128 by an insert portion 129 which engages into a recess 130 in the cylindrical wall 131 of the striking head. The insert portion 129 is square in transverse cross section and includes a conventional locating ball 133 which engages into an indent in the side wall of the square recess 130 in the striking head. Thus the portion 126 extends outwardly from the striking head of the hammer at right angles to the striking access. The support portion 126 carries a head 135 substantially shaped as previously described with a curved outer surface 136, a claw 137 and an anvil head 138. The underside of the claw provides a generally planar surface 140 which is parallel to an end face 141 of the hammer so as to define a space 142 therebetween which matches the dimensions of a 2 by four board. Thus the space has a dimension of the order of 1⅝ inch so that the board has one flat face sliding against the surface 141 of the hammer and a second flat face sliding against the underside 140 of the head 135 allowing it to move to a position butting the support portion 126 thus holding the board in place and allowing it to be grasped and twisted or levered by being held within the channel defined by the space 142.

This embodiment therefore is substantially as previously described except that the sleeve mounting arrangement of the previous embodiment is replaced by an insert mounting arrangement defined by the square insert 129. This requires therefore that specialized hammer be developed and manufactured which co-operates with the claw head since conventional hammers do not include the square recess 130. Thus the hammer and claw tool provide a combination which can be sold together with the tool inserted on the hammer or used separately as previously described.

Since various modifications can be made in my invention as hereinbefore described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A combination of a claw hammer and a tool for use therewith in removing nails comprising:

a claw hammer having:

a shank and a generally T-shaped hammer head having a shank engaging portion defining a leg of the T-shape end in engagement with the shank;

a striker body on one side of the T-shape having an end striker face generally at right angles to a striker axis which is at right angles to the shank and a peripheral surface surrounding the striker axis;

and a claw body on a side of said T-shape opposite to said striker body including a pair of claw fingers projecting away from the shank defining a slot therebetween for receiving and grasping a nail head of a nail in a surface for removal;

and a tool having:

an integral tool body having a mounting portion, a support portion and a surface engaging portion;

the mounting portion defining a member shaped to engage the striker body so as to be supported on the striker body by the engagement between the striker body and the mounting portion;

the support portion extending outwardly to one side of the mounting portion generally at right angles to the striker axis and in a direction opposite to the shank;

the surface engaging portion being mounted on an end of the support portion remote from the mounting portion and providing a curved fulcrum surface for resting on an element from which the nail is to be pulled with the shank lying in a plane at right angles to the element;

the curved fulcrum surface being curved in a direction to roll over the element as the tool is pivoted relative to the element in said plane about an axis at right angles to the striker axis and at right angles to the shank;

the surface engaging portion including an anvil surface at one end and a second claw body at an opposed end, said second claw body including a second pair of claw fingers projecting away from the anvil surface and defining a slot therebetween for receiving and grasping a nail head of a nail.

2. A combination of a claw hammer and a tool for use therewith in removing nails comprising:

a claw hammer having:

a shank and a generally T-shaped hammer head having a shank engaging portion defining a leg of the T-shape and in engagement with the shank;

a striker body on one side of the T-shape having an end striker face generally at right angles to a striker axis which is at right angles to the shank and a peripheral surface surrounding the striker axis;

and a claw body on a side of said T-shape opposite to said striker body including a pair of claw fingers projecting away from the shank defining a slot therebetween for receiving and grasping a nail head of a nail in a surface for removal;

and a tool having:

an integral tool body having a mounting portion, a support portion and a surface engaging portion;

the mounting portion comprising a cylindrical sleeve member shaped to receive and surround the peripheral surface of the striker body as a sliding fit therein so as to be supported on the striker body by the engagement between the striker body and the cylindrical sleeve member;

the support portion extending outwardly to one side of the mounting portion generally at right angles to the striker axis and in a direction opposite to the shank;

the surface engaging portion being mounted on an end of the support portion remote from the mounting portion and providing a curved fulcrum surface for resting on an element from which the nail is to be pulled with the shank lying in a plane at right angles to the element;

the curved fulcrum surface being curved in a direction to roll over the element as the tool is pivoted relative to the element in said plane about an axis at right angles to the striker axis and at right angles to the shank;

the surface engaging portion including an anvil surface at one end and a second claw body at an opposed end, said second claw body including a second pair of claw fingers projecting away from the anvil surface and defining a slot therebetween for receiving and grasping a nail head of a nail.

3. The combination according to claim 2 wherein the cylindrical sleeve member includes a fastener for fastening the cylindrical sleeve member to the striker body.

4. The combination according to claim 3 wherein the fastener comprises a spring ball member mounted on the striker body and a recess in an inner surface of the cylindrical sleeve member for receiving a spring ball as a snap fastening therein.

5. The combination according to claim 3 wherein the fastener comprises a set screw threadedly mounted on the cylindrical sleeve member and rotatable for engagement with the peripheral surface of the striker body.

6. A tool for mounting on a claw hammer for use with the claw hammer comprising:

a tool body having a receptacle portion defining circular cylindrical recess sleeve member having an open end face generally at right angles to a longitudinal axis of the sleeve member, a support portion extending from the receptacle portion generally at right angles to the longitudinal axis, and an engagement portion on an end of the support portion remote from the receptacle portion and defining a curved fulcrum surface facing away from the receptacle portion;

the curved fulcrum surface extending over an arc commencing at one end and terminating at a second end both ends being arranged at positions spaced from said longitudinal axis;

said engagement portion having at said one end an anvil surface thereon transverse to the surface and generally transverse to the longitudinal axis for driving the engagement portion generally longitudinally of the longitudinal axis;

and said engagement portion having at said second end a claw member separate from a claw hammer with which the tool is to be used and defined by a pair of claw fingers having therebetween a v-shape notch lying for grasping a nail head between said fingers, the fingers and the slot being arranged along a line generally parallel to the longitudinal axis such that impact on the anvil surface along the line drives the claw member into engagement with the nail.

7. The tool according to claim 6 wherein the receptacle portion includes a fastener for fastening the sleeve member to a striker body of a claw hammer with which the tool is to be used.

8. The tool according to claim 7 wherein the fastener comprises a set screw threadedly mounted on the sleeve member.

* * * * *